US007509080B2

(12) United States Patent
Iwata et al.

(10) Patent No.: US 7,509,080 B2
(45) Date of Patent: Mar. 24, 2009

(54) DEVELOPING UNIT WITH DEVELOPER OPENING/CLOSING MEMBER

(75) Inventors: Naoya Iwata, Ebina (JP); Tomoyoshi Chihara, Ebina (JP); Tetsuji Okamoto, Ebina (JP); Akihide Kawamura, Ebina (JP)

(73) Assignee: FUJIFILM Corporation, Tokyo (JP)

( * ) Notice: Subject to any disclaimer, the term of this patent is extended or adjusted under 35 U.S.C. 154(b) by 128 days.

(21) Appl. No.: 11/655,919

(22) Filed: Jan. 22, 2007

(65) Prior Publication Data

US 2007/0183813 A1 Aug. 9, 2007

(30) Foreign Application Priority Data

Feb. 6, 2006 (JP) ..... 2006-027993

(51) Int. Cl.
*G03G 15/08* (2006.01)
*G03G 15/01* (2006.01)

(52) U.S. Cl. ..... 399/258; 399/227

(58) Field of Classification Search ..... 399/227, 399/256, 257, 258
See application file for complete search history.

(56) References Cited

U.S. PATENT DOCUMENTS

| | | | | |
|---|---|---|---|---|
| 6,987,940 | B2 * | 1/2006 | Tamura | 399/227 |
| 7,356,288 | B2 * | 4/2008 | Iwata et al. | 399/256 X |
| 2002/0090230 | A1 * | 7/2002 | Hatori et al. | 399/227 |
| 2005/0254860 | A1 * | 11/2005 | Kimura et al. | 399/227 |
| 2006/0204281 | A1 * | 9/2006 | Wada et al. | 399/227 |
| 2007/0053720 | A1 * | 3/2007 | Nishihama et al. | 399/227 |
| 2007/0189808 | A1 * | 8/2007 | Kato et al. | 399/227 |

FOREIGN PATENT DOCUMENTS

| | | | |
|---|---|---|---|
| JP | A 07-333978 | | 12/1995 |
| JP | A 9-218575 | | 8/1997 |
| JP | A 09-218575 | | 8/1997 |
| JP | 09-236985 | A * | 9/1997 |
| JP | 11-295983 | A * | 10/1999 |
| JP | A 2000-105494 | | 4/2000 |
| JP | A 2000-112229 | | 4/2000 |
| JP | A 2002-072642 | | 3/2002 |
| JP | 2002-258611 | A * | 9/2002 |
| JP | A 2003-114578 | | 4/2003 |
| JP | A2003-323028 | | 11/2003 |

OTHER PUBLICATIONS

Machine translation of JP 2002-258611 A dated Jul. 27, 2008.*

* cited by examiner

*Primary Examiner*—Sophia S Chen
(74) *Attorney, Agent, or Firm*—Margaret A. Burke; Sheldon J. Moss

(57) ABSTRACT

A developing unit which includes a conveying shaft; a developing conveying portion conveying a developer in an axial direction as the conveying shaft rotates; a discharge opening discharging the developer from the inner wall surface; an accumulating chamber accumulating the discharged developer; and an opening/closing member opening and closing the discharge opening due to its own weight as the rotating body rotates, and being in an open state at the developing position, an opening/closing fulcrum of the opening/closing member being at a lower end portion of the opening/closing member at the developing position, the developing unit being held at a rotating body, and successively being made to oppose a developing position of an image carrier due to rotation of the rotating body.

15 Claims, 15 Drawing Sheets

DEVELOPING UNIT WITH DEVELOPER OPENING/CLOSING MEMBER

CROSS-REFERENCE TO RELATED APPLICATIONS

This application is based on and claims priority under 35 USC 119 from Japanese Patent Application No. 2006-027993 filed Feb. 6, 2006.

BACKGROUND

1. Technical Field

The present invention relates to a developing unit.

2. Related Art

In the trickle method, a developer, in which toner and carrier are mixed-together in advance, is housed in a developer cartridge, and, simultaneously with the supplying of the toner from the developer cartridge to a developing unit, new carrier also is supplied bit-by-bit. Because the amount of the developer within the developing unit increases at this time, when an amount which is greater than or equal to a given amount has accumulated, the excess developer is discharged to the exterior of the developing unit. Accordingly, the developer is stable and does not deteriorate, i.e., the charge amount thereof does not fall to less than or equal to a predetermined value.

SUMMARY

According to an aspect of the invention, there is provided: a developing unit, comprising: a conveying shaft provided within the developing unit and rotates; a developing conveying portion that is spiral-shaped, formed at an outer periphery of the conveying shaft, and conveys a developer in an axial direction as the conveying shaft rotates; a discharge opening provided in an inner wall surface which opposes the conveying shaft, and discharging the developer from the inner wall surface; an accumulating chamber accumulating the developer discharged from the discharge opening; and an opening/closing member that is plate-shaped, and opens and closes the discharge opening due to its own weight as the rotating body rotates, and is in an open state at the developing position, the developing unit being held at a rotating body, and successively being made to oppose a developing position of an image carrier due to rotation of the rotating body, the opening/closing member having an opening/closing fulcrum at a lower end portion of the opening/closing member at the developing position.

BRIEF DESCRIPTION OF THE DRAWINGS

An exemplary embodiment of the present invention will be described in detail based on the following figures, wherein.

DETAILED DESCRIPTION

A developing unit relating to the present invention will be described next. Note that illustration and description of structures which are not directly related to the gist of the present invention are omitted.

Figure 1:
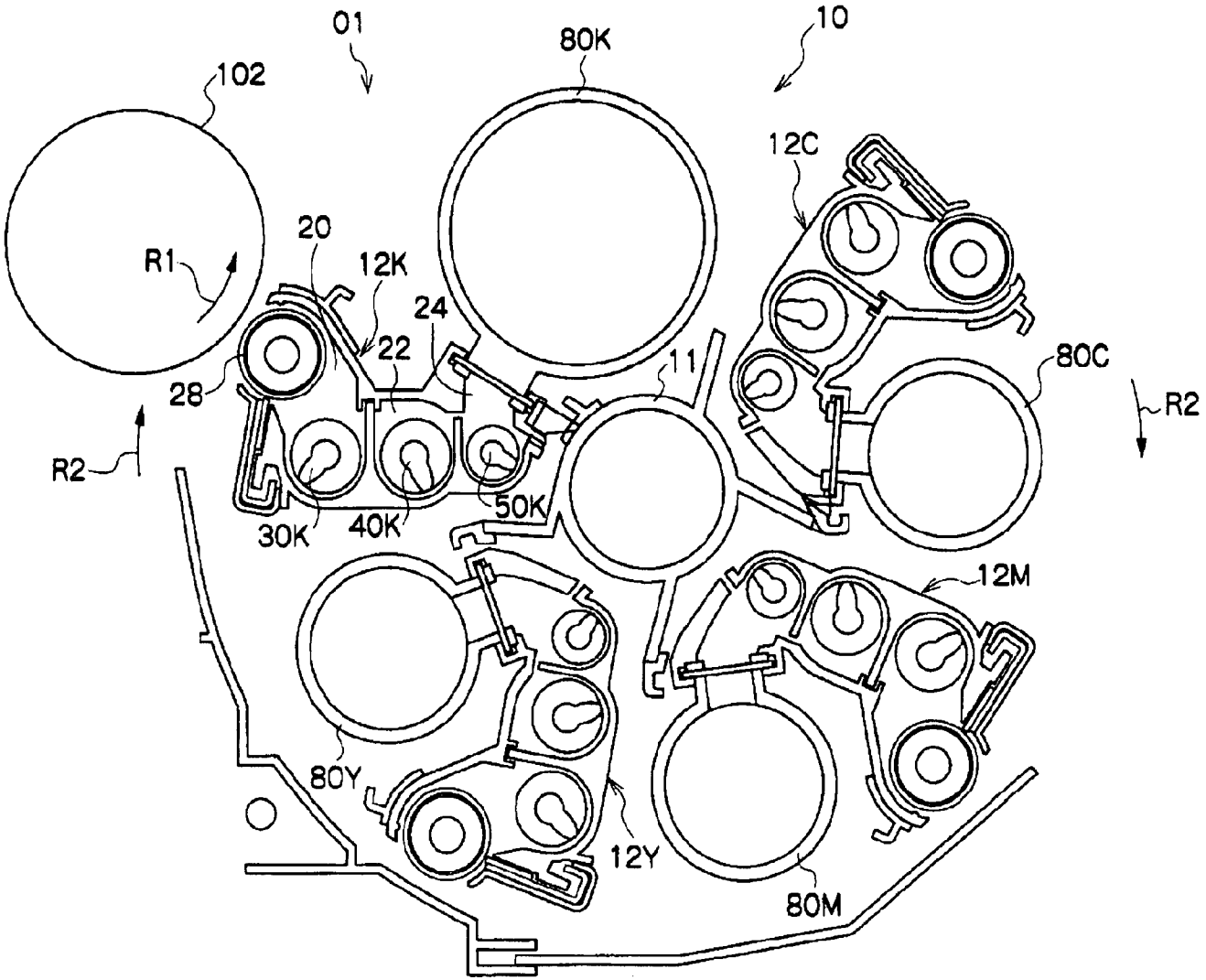
FIG. 1 is a drawing showing the schematic structure of a rotary developing apparatus which is equipped with developing units of an exemplary embodiment of the present invention.

FIG. 1 is a structural diagram showing main portions of an image forming apparatus 01 at which a rotary developing apparatus 10 having developing units 12 of respective colors is provided. The image forming apparatus 01 forms an image on a recording medium, such as a recording sheet or the like, by an electrophotographic process. A so-called two-component developing method is used for the developing method. Further, the trickle method is employed.

The trickle method is a method in which a developer, in which toner and carrier are mixed-together in advance, is accommodated in a developer cartridge 80, the toner and the carrier are simultaneously supplied from the developer cartridge 80 to the developing unit 12, the excess developer is discharged-out, and deterioration of the developer is prevented.

As shown in FIG. 1, in the image forming apparatus 01, an electrophotographic photosensitive body which is shaped as a drum and serves as an image carrier, i.e., a photosensitive drum 102, is supported so as to be able to rotate in the direction of arrow R1 in FIG. 1. The surface of the photosensitive drum 102 which rotates in the direction of arrow R1 is charged by a charging portion (not illustrated). Due to an exposure portion (not shown) irradiating laser light or the like corresponding to image information onto the charged photosensitive drum 102 and exposing the photosensitive drum 102, electrostatic latent images are formed on the photosensitive drum 102. The electrostatic latent images are developed by the developing units 12 of the rotary developing apparatus 10, and toner images are formed on the photosensitive drum 102.

The rotary developing apparatus 10 has a rotating body 11 at the central portion thereof. The rotating body 11 holds a developing unit 12K for black, a developing unit 12Y for yellow, a developing unit 12M for magenta, and a developing unit 1 2C for cyan. The rotating shaft of the rotating body 11 can rotate freely in the direction of arrow R2 due to a driving portion (not shown) such as a motor, a gear mechanism, and the like.

Hereinafter, when the respective colors are to be differentiated, one of the letters Y, M, C, K is added after the reference numeral, whereas the letter Y, M, C, K is omitted if there is no need to distinguish between the respective colors.

When forming a black toner image on the photosensitive drum 102, the rotating body 11 is rotated, the developing unit 12K for black is disposed at a developing position P1 (see FIG. 2) which is adjacent to the photosensitive drum 102, and developing is carried out. Similarly, when forming a yellow toner image, the rotating body 11 is rotated substantially 90° in the direction of arrow R2, the developing unit 12Y for yellow is disposed at the developing position P1, and developing is carried out. Similarly, when forming magenta and cyan toner images, the rotating body 11 is rotated in the direction of arrow R2 a further 90° respectively, the developing unit 12M or 12C is disposed at the developing position P1, and development is carried out.

In this way, toner images of the respective colors are formed in order on the photosensitive drum 102, and each time, are transferred onto an intermediate transfer body (not shown). The respective color toner images are superposed one on another on the intermediate transfer body so as to form a full color toner image. The full color toner image on the intermediate transfer body is transferred all at once onto a recording sheet (not shown) or the like.

Figure 2:
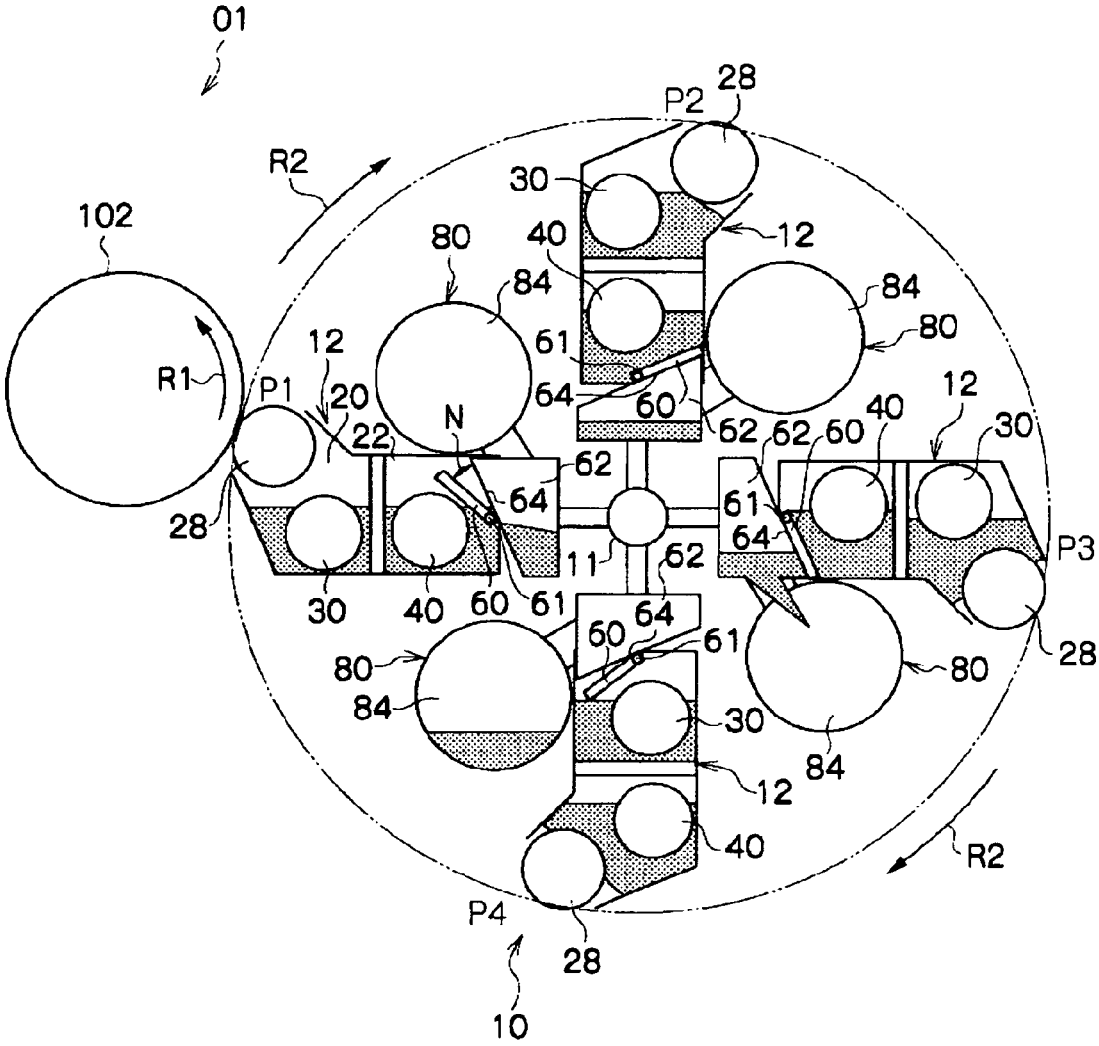
FIG. 2 is an explanatory diagram schematically illustrating the developing apparatus equipped with the developing units of the exemplary embodiment of the present invention, and explains an opening/closing operation of an opening/closing member and discharging of excess developer from a discharge opening, which accompany rotation of a rotating body.

As shown in FIG. 2, the position where the developing unit 12 develops the image on the photosensitive drum 102 is the developing position P1. Further, the position rotated 90° in the direction of arrow R2 from the developing position P1 is position P2. Similarly, the position rotated 90° from position P2 is position P3, and the position rotated 90° from position P3 is position P4. The position rotated 90° from position P4 is the developing position P1. Note that FIG. 2 is a drawing which is simplified and provides a schematic illustration.

The developing unit 12 will be described next. Note that each of the drawings of the developing unit 12 as a single unit illustrates the state at the developing position P1 (see FIG. 2).

Figure 3:
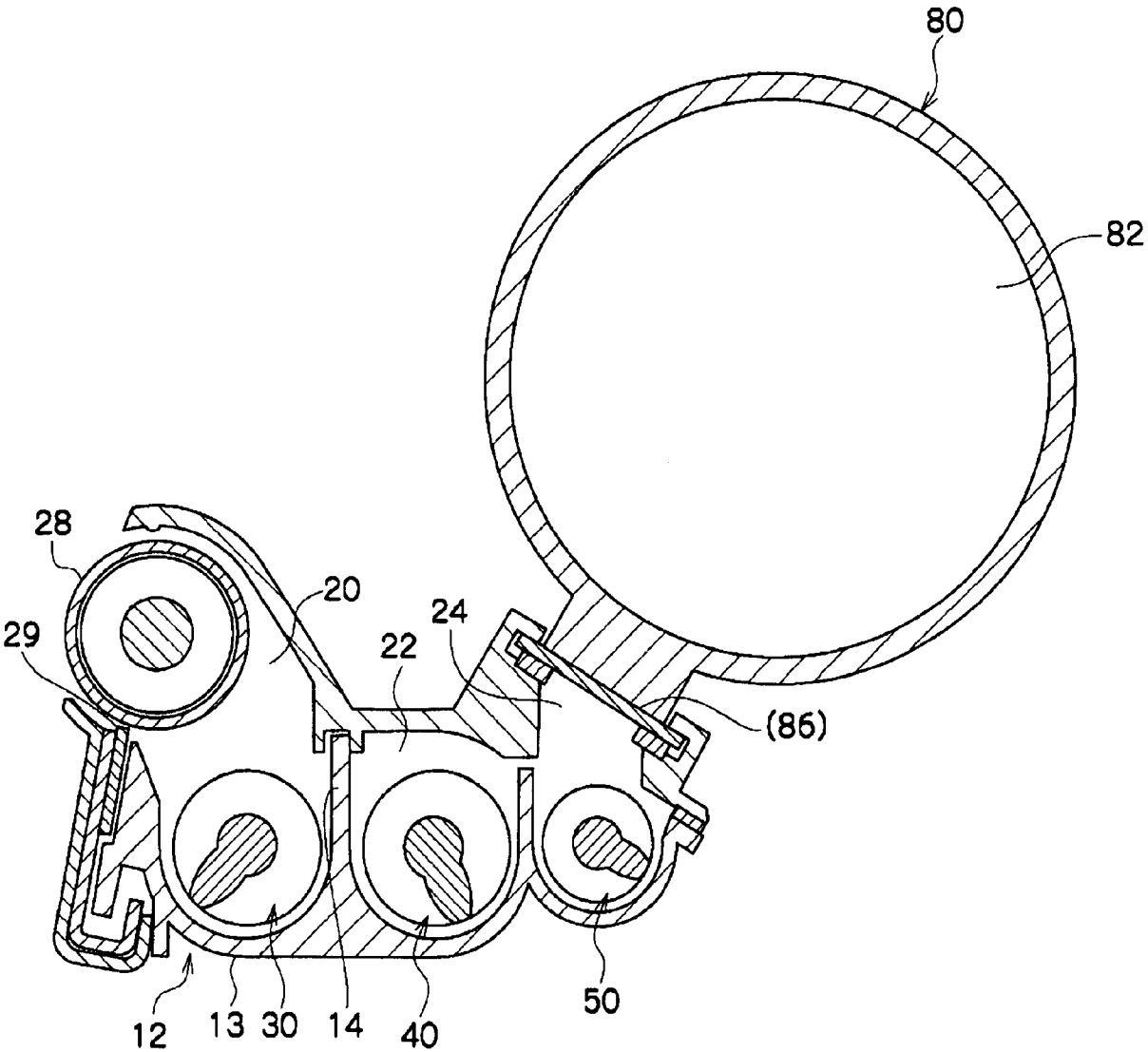
FIG. 3 is a cross-sectional view of the interior of the developing unit viewed from a lateral direction.

As shown in FIG. 3, the developing unit 12 is divided into three chambers which are a first chamber 20, a second chamber 22, and a third chamber 24. The first chamber 20 and the second chamber 22 communicate with one another, and the second chamber 22 and the third chamber 24 communicate with one another. Further, the developer cartridge 80 communicates with the third chamber 24. The first chamber 20, the second chamber 22, and the third chamber 24 are filled with developer which is formed from toner and carrier and is supplied from the developer cartridge 80.

The first chamber 20 has a developing roller 28 and a first stirring/conveying auger 30. A second stirring/conveying auger 40 is provided in the second chamber 22. An auger 50 for replenishing is provided in the third chamber 24. Each rotates around a rotational axis which is perpendicular to the surface of FIG. 3. In other words, as shown in FIG. 4, the developing roller 28, the first stirring/conveying auger 30, the second stirring/conveying auger 40, and the auger 50 for replenishing, which are shaped as rods and which rotate, are lined-up in parallel.

Note that, at the developing position P1, the developing roller 28 is at a position opposing the photosensitive drum 102 (see FIG. 2). As shown in FIG. 3, the developing roller 28 is rotatably pivotally-supported at the lateral side walls of a case 13, and is rotated by an unillustrated gear mechanism. The developing roller 28 is a magnetic roller in which a magnet is included within a sleeve. Accordingly, the developing roller 28 attracts the carrier contained in the developer by magnetic force so as to form a magnetic brush, and the toner is attracted to the carrier. Then, the developer is formed into a layer on the developing roller 28 by a layer regulating member 29.

Figure 4:
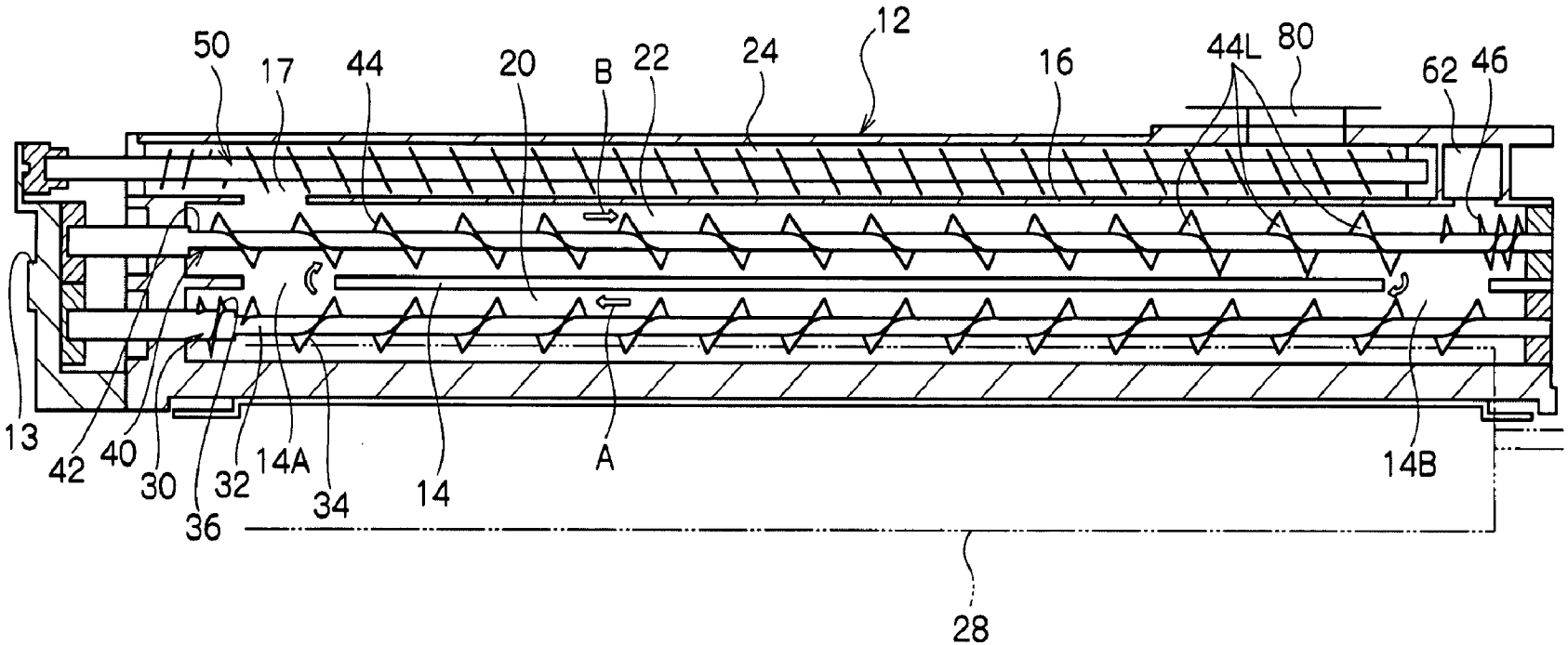
FIG. 4 is a cross-sectional view of the interior of the developing unit viewed from above.

As shown in FIGS. 3 and 4, the first stirring/conveying auger 30 and the second stirring/conveying auger 40 are disposed parallel to the developing roller 28, and are pivotally-supported at the lateral side walls of the case 13. Unillustrated gear mechanisms are provided at end portions of shafts 32, 42 of the first stirring/conveying auger 30 and the second stirring/conveying auger 40, and the first stirring/conveying auger 30 and the second stirring/conveying auger 40 rotate in the same direction as the developing roller 28.

As shown in FIG. 4, a developer conveying portion 34 is formed at the outer periphery of the shaft 32 of the first stirring/conveying auger 30. The developer conveying portion 34 is formed in a spiral shape. Similarly, a developer conveying portion 44 is formed at the outer periphery of the shaft 42 of the second stirring/conveying auger 40. The developer conveying portion 44 is formed in the shape of a spiral which is inclined in the opposite direction to the developer conveying portion 34.

Accordingly, when the first stirring/conveying auger 30 and the second stirring/conveying auger 40 rotate as the developing roller 28 rotates, the first stirring/conveying auger 30 stirs the developer while conveying it in the direction of arrow A, and supplies the developer to the developing roller 28. Further, the second stirring/conveying auger 40 stirs the developer while conveying it in the direction of arrow B (the direction opposite to arrow A).

As shown in FIGS. 3 and 4, a partitioning plate 14 which partitions between the first stirring/conveying auger 30 and the second stirring/conveying auger 40 along the longitudinal direction, i.e., which partitions the first chamber 20 and the second chamber 22, is provided at the case 13.

As shown in FIG. 4, circuiting openings 14A, 14B are formed at both end portions in the longitudinal direction of the partitioning plate 14. Accordingly, the developer which is stirred and conveyed by the first stirring/conveying auger 30 is conveyed through the circuiting opening 14A to the second chamber 22, and the developer which is stirred and conveyed by the second stirring/conveying auger 40 is conveyed through the circuiting opening 14B to the first chamber 20. Namely, the developer circulates around the partitioning plate 14.

Developer reverse direction conveying portions 36, 46, which are wound reversely to the developer conveying portions 34, 44, are provided at the respective developer conveying direction side end portions of the first stirring/conveying auger 30 and the second stirring/conveying auger 40.

The pitches of the developer reverse direction conveying portions 36, 46 are narrower than those of the developer conveying portions 34, 44. The angles of inclination of the developer reverse direction conveying portions 36, 46 as well are smaller than those of the developer conveying portions 34, 44. Accordingly, the developer conveying performance of the developer reverse direction conveying portions 36, 46 is inferior to that of the developer conveying portions 34, 44. Note that the developer conveying portion 34 of the first stirring/conveying auger 30 and the developer conveying portion 44 of the second stirring/conveying auger 40 have substantially the same conveying performance.

By providing the developer reverse direction conveying portions 36, 46 at the both end portions in this way, the developer accumulates at the border portions between the developer conveying portions 34, 44 and the developer reverse direction conveying portions 36, 46, without being pushed-up against the lateral side walls of the case 13. Further, because the developer is smoothly discharged-out from the circuiting openings 14A, 14B at the both end portions, the developer circulates smoothly around the partitioning plate 14 between the first chamber 20 and the second chamber 22.

Figure 5A:
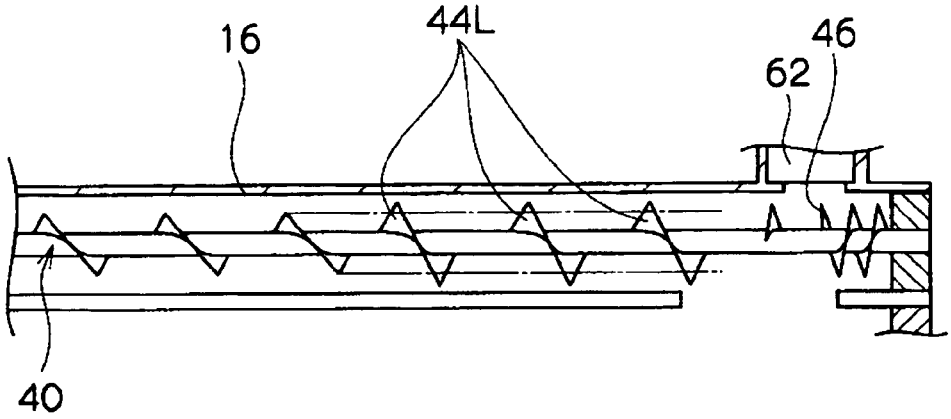
FIG. 5A is an enlarged view in which a vicinity of the discharge opening is enlarged.

As shown in FIG. 5A, the outer diameter of only a portion 44L of three windings at the conveying direction downstream side end portion side of the developer conveying portion 44 of the second stirring/conveying auger 40 is made to be slightly larger (in the present exemplary embodiment, about 0.5 mm larger), such that the force of conveying the developer thereat is increased.

As shown in FIG. 4, the auger 50 for replenishing is pivotally-supported at the lateral side walls, parallel to the second stirring/conveying auger 40. A partitioning plate 16 is formed between the auger 50 for replenishing and the second stirring/conveying auger 40.

As shown in FIG. 3, the developer cartridge 80 is mounted above the auger 50 for replenishing, i.e., above the third chamber 24.

Figure 8:
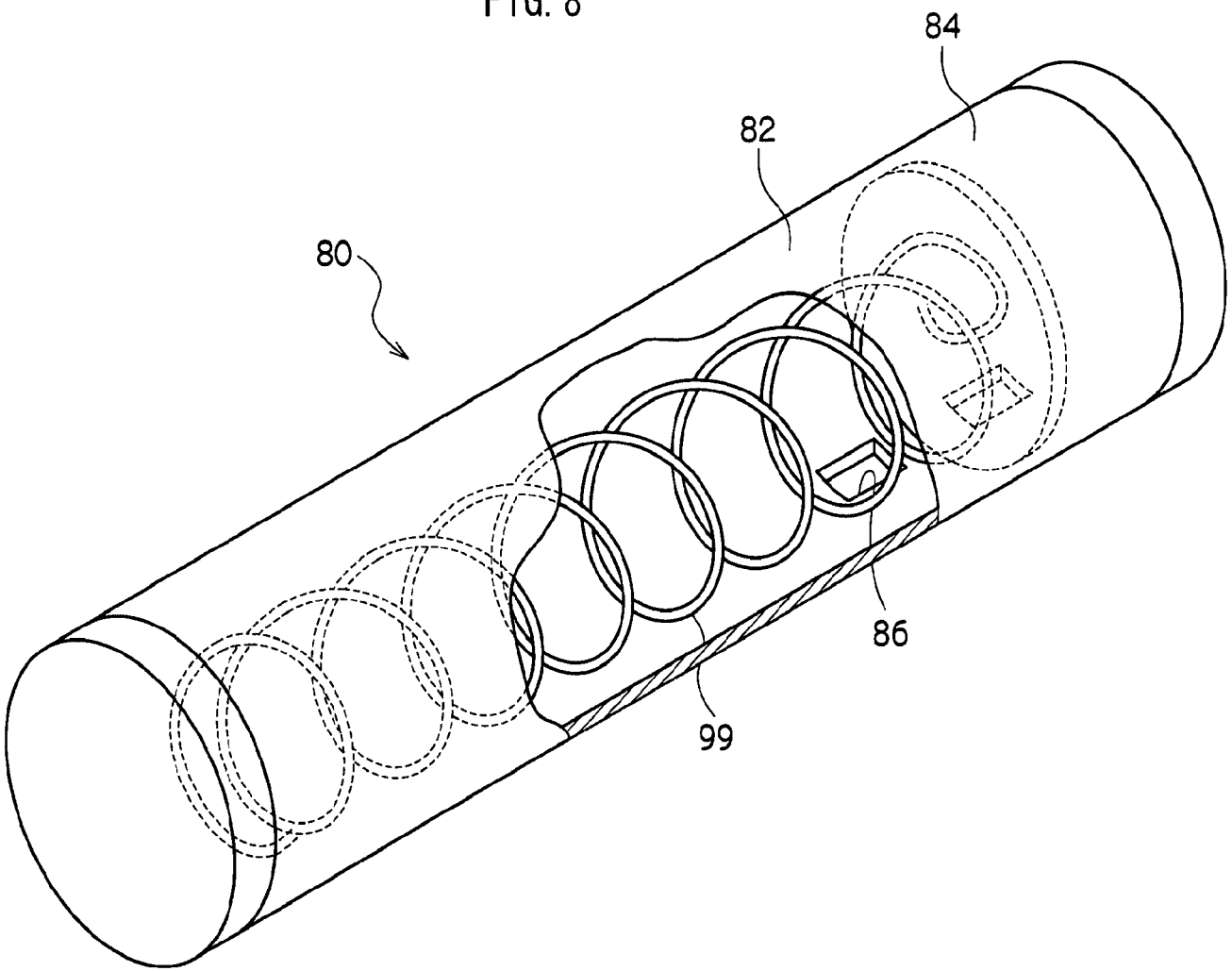
FIG. 8 is a drawing schematically showing a developer cartridge.

As shown in FIG. 8, the developer cartridge 80 is shaped as a cylindrical tube, and the interior thereof is divided into an accommodating chamber 82 and a recovery chamber 84. A conveying member 99 shaped as a coil spring is provided within the accommodating chamber 82. Due to the rotation operation of the conveying member 99, the developer is replenished to the third chamber 24 from a replenishing opening 86 (see FIGS. 3 and 4).

As shown in FIG. 4, the replenished developer is conveyed by the auger 50 for replenishing, and is replenished to the second chamber 22 from a supply opening 17 formed in the partitioning plate 16. Further, in accordance with the image density at the time of image formation, a control portion (not shown) rotates the auger 50 for replenishing of the third chamber 24 and replenishes the developer to the second chamber 22.

Figure 6:
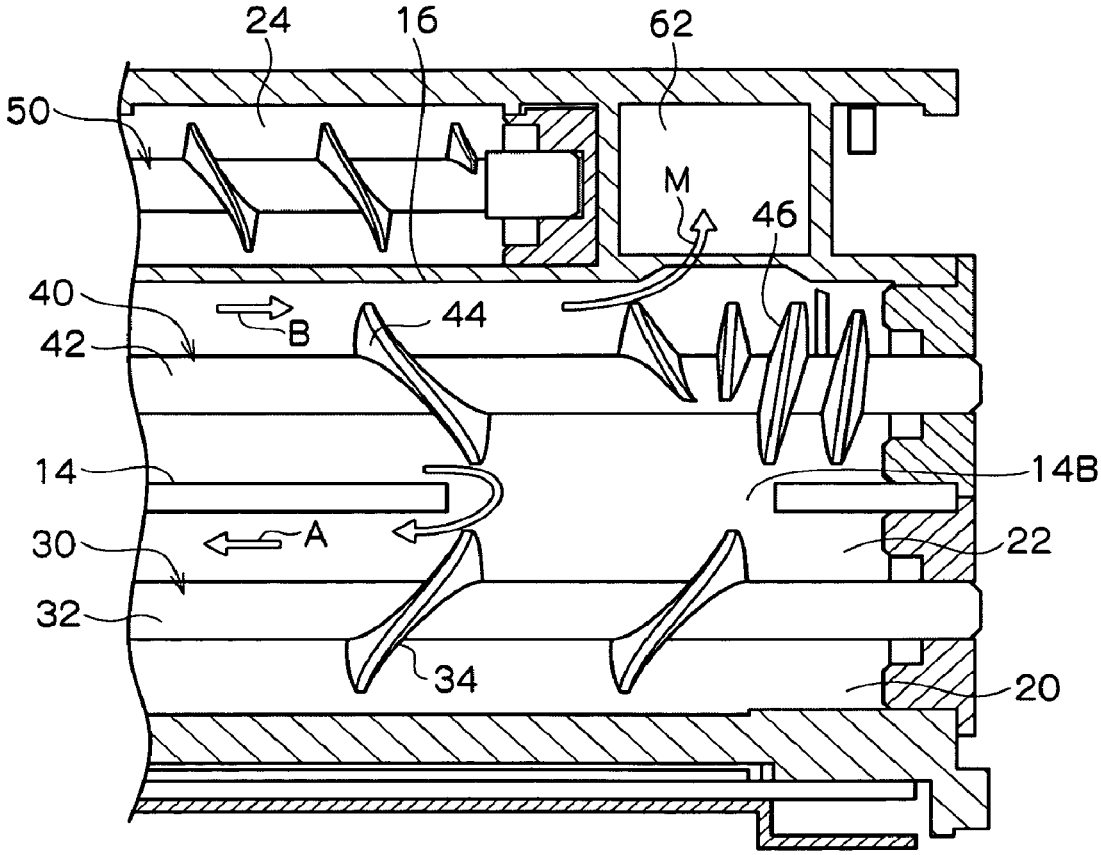
FIG. 6 is a drawing of a vicinity of the discharge opening at the interior of the developing unit.

As shown in FIGS. 4, 5A and 6, the third chamber 24 extends to short of the conveying direction (arrow B direction) downstream side end portion of the developer conveying portion 44 of the second stirring/conveying auger 40, and is shorter than the first chamber 20 and the second chamber 22. The portion by which it is shorter is an accumulating chamber 62.

Figure 9:
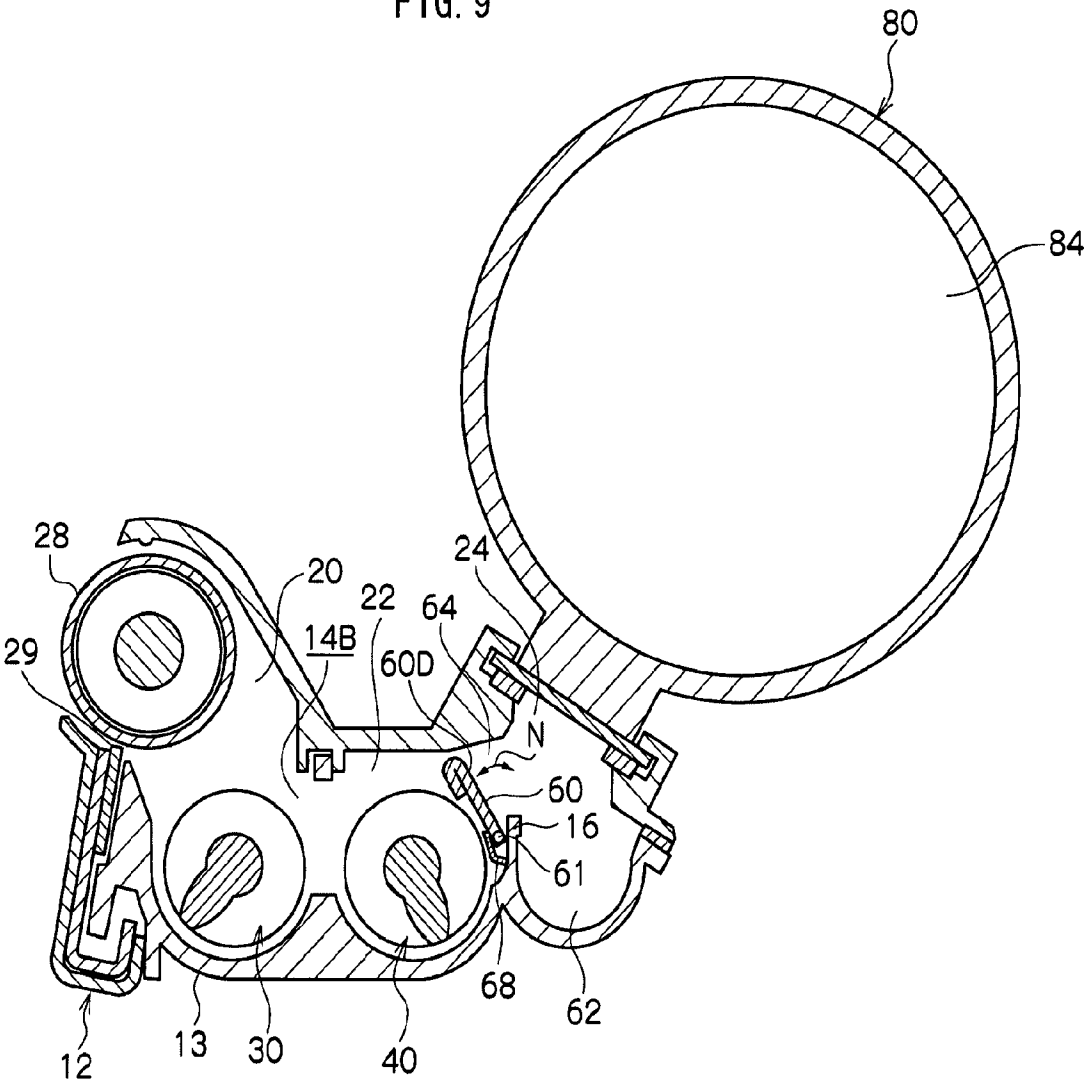
FIG. 9 is a cross-sectional view of the interior of the developing unit seen from a lateral direction, and including the discharge opening portion.

As shown in FIG. 9, the upper portion of the accumulating chamber 62 communicates with the recovery chamber 84 (see FIG. 8) of the developer cartridge 80.

Figure 7:
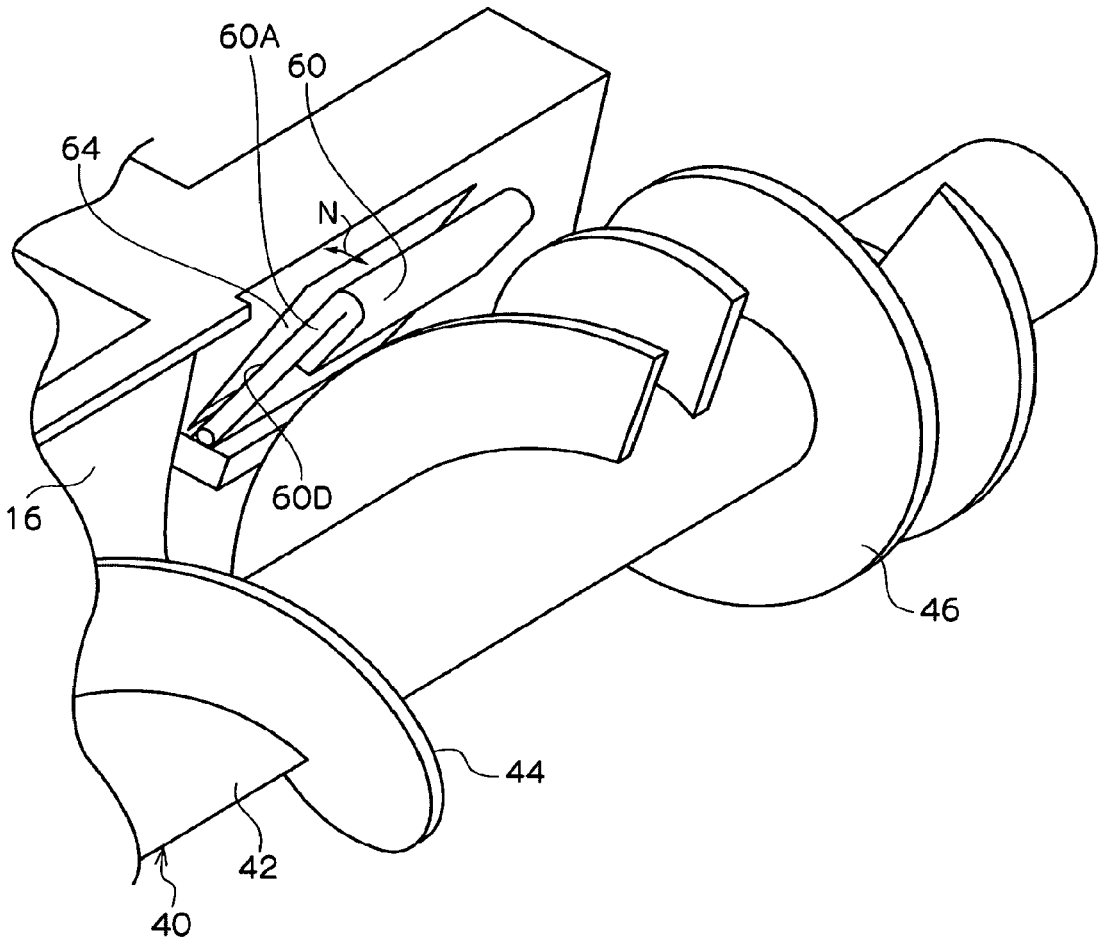
FIG. 7 is a perspective view of a vicinity of the discharge opening at the interior of the developing unit.

As shown in FIGS. 7 and 9, a discharge opening 64 is formed in the inner wall surface opposing the border portion between the developer conveying portion 44 and the developer reverse direction conveying portion 46 of the second stirring/conveying auger 40, i.e., in the partitioning plate 16 which partitions the accumulating chamber 62 (see FIGS. 5A and 5B) and the second chamber 22.

As shown in FIGS. 2, 7 and 9 and the like, a plate-shaped opening/closing member 60 is provided between the discharge opening 64 and the second stirring/conveying auger 40. The opening/closing member 60 rotates around a rotating shaft 61 which is formed at the lower end portion of the opening/closing member 60 at the developing position P1. The rotating shaft 61 is disposed lower than the lower end of the discharge opening 64.

As shown in FIGS. 2, 7, 9 and 13, due to the upper end of the opening/closing member 60 rotating as shown by arrow N by its own weight due to the rotation of the rotating body 11 (the change in the direction of working of gravity), the discharge opening 64 is opened and closed. Note that, at the developing position P1, the opening/closing member 60 is in an open state.

Figure 13:
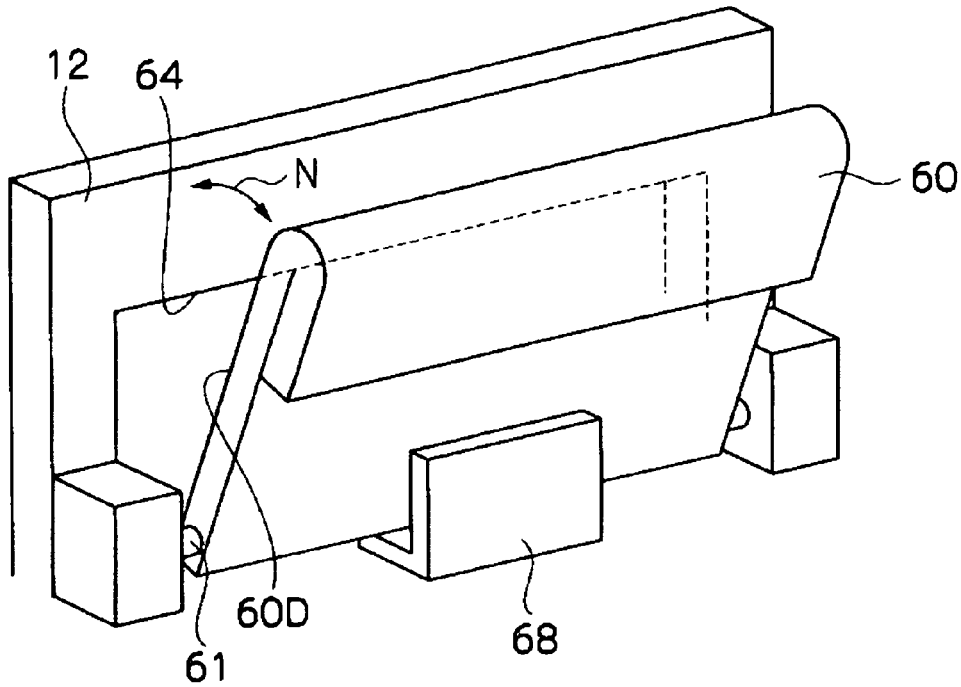
FIG. 13 is a perspective view showing the opening/closing member and the discharge opening.

Due to the opening/closing member 60 abutting a stopper 68 as shown in FIGS. 9 and 13, the opening/closing member 60 is stopped in a state of being open at a predetermined angle.

Figure 14:
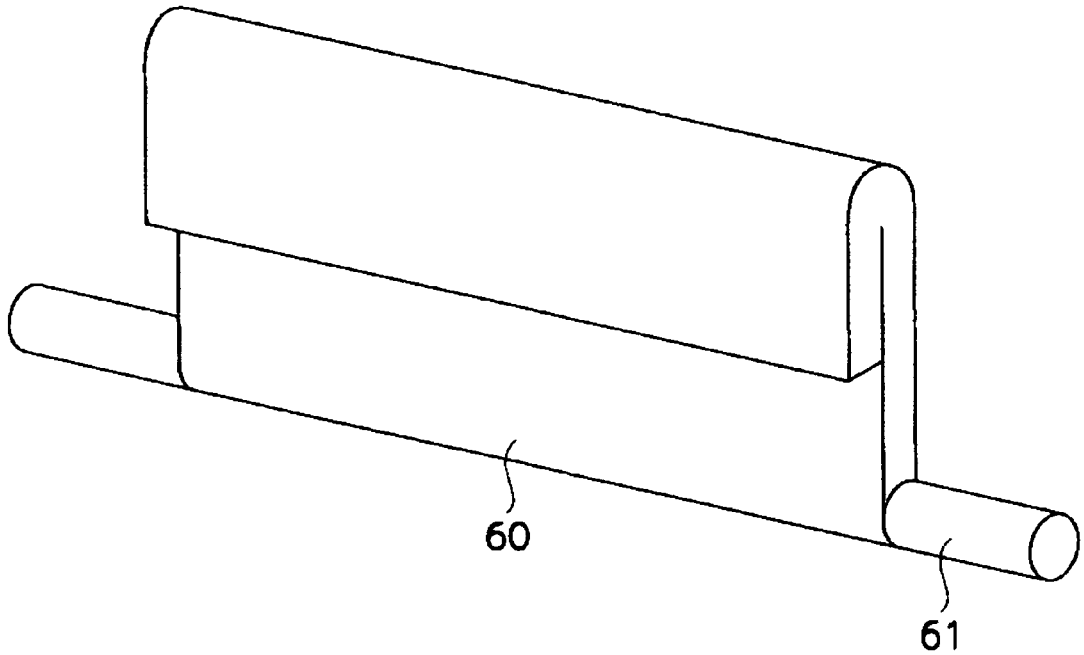
FIG. 14 is a perspective view showing the opening/closing member.

As shown in FIGS. 13 and 14, the upper end portion of the opening/closing member 60 is folded-over and made to be thick, such that the upper end portion is heavier than the lower end portion (the end portion at the side opposite to the rotating shaft 61 is heavier). Namely, the center of gravity of the opening/closing member 60 is above the center.

Figure 10A:
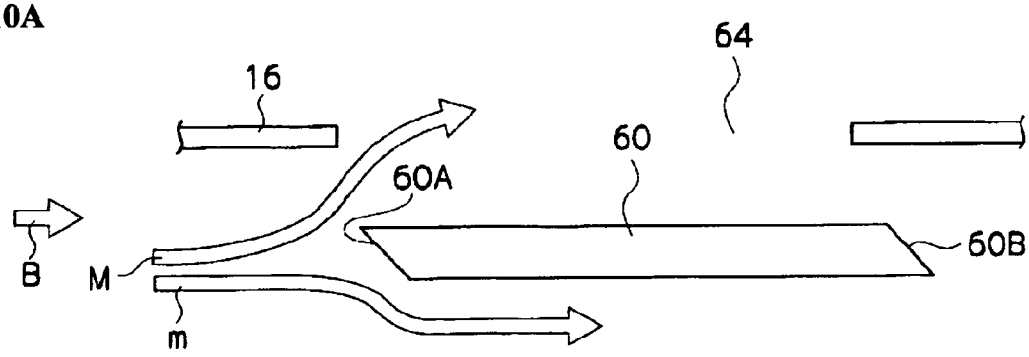
FIG. 10A is a schematic diagram of a cross-section of a state in which the opening/closing member is open.
Figure 10B:
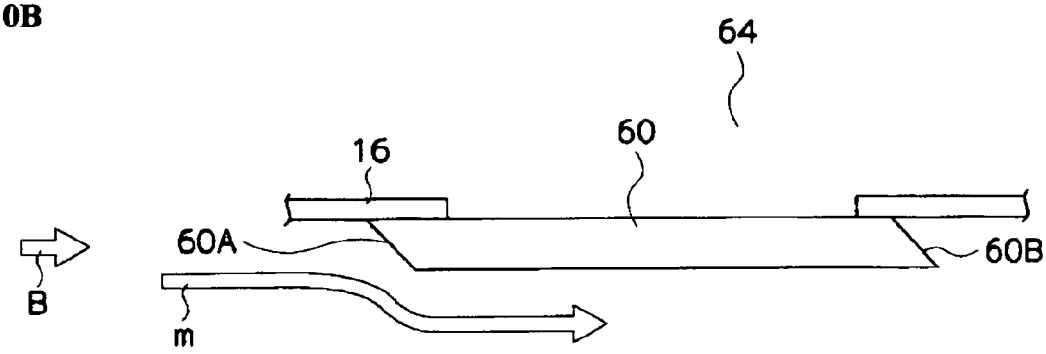
FIG. 10B is a schematic diagram of a cross-section of a state in which the opening/closing member is closed.

As shown in FIGS. 10A and 10B, the end portion of the opening/closing member 60 at the upstream side in the conveying direction of the developer (the arrow B direction) is formed in the shape of a wedge which tapers in the direction opposing the developer conveying direction (the arrow B direction), such that an inclined surface 60A is formed. This inclined surface 60A is formed at the surface at the side opposite to the discharge opening 64. Further, an inclined surface 60B is formed at the discharge opening 64 side of the end portion at the opposite side (the end portion at the downstream side in the conveying direction), such that the left and right end portions (the end portions at the upstream side and the downstream side) have point symmetry. Namely, the left and right end portions have the same shape even when opening/closing member 60 is rotated 180°.

The opening/closing operation of the opening/closing member 60 and the discharging of the excess developer from the discharge opening 64, which accompany the rotation of the rotating body 11 (the change in the direction in which gravity works), will be described next.

As shown in FIG. 2, at the developing position P 1, the opening/closing member 60 is open. Accordingly, if the level of the developer starts to become higher than a predetermined height, the excess developer is discharged-out from the discharge opening 64 (refer to FIGS. 6, 12 and 17A as well). The developer which is discharged-out from the discharge opening 64 is accumulated in the accumulating chamber 62.

When the developing unit 12 is rotated 90° and arrives at position P2, the opening/closing member 60 closes the discharge opening 64 by its own weight. Accordingly, the developer cannot be discharged-out from the discharge opening 64 to the accumulating chamber 62.

When the developing unit 12 is rotated a further 90° and arrives at position P3, the developer in the accumulating chamber 62 is sent into the recovery chamber 84 of the developer cartridge 80 due to gravity.

When the developing unit 12 is rotated still another 90° and arrives at position P4, the opening/closing member 60 opens due to its own weight. However, because the discharge opening 64 is positioned above, the developer is not discharged-out from the discharge opening 64 to the accumulating chamber 62.

When the developing unit 12 is rotated another 90°, it arrives at the original developing position P1.

Operation of the present exemplary embodiment will be described next.

Figure 12:
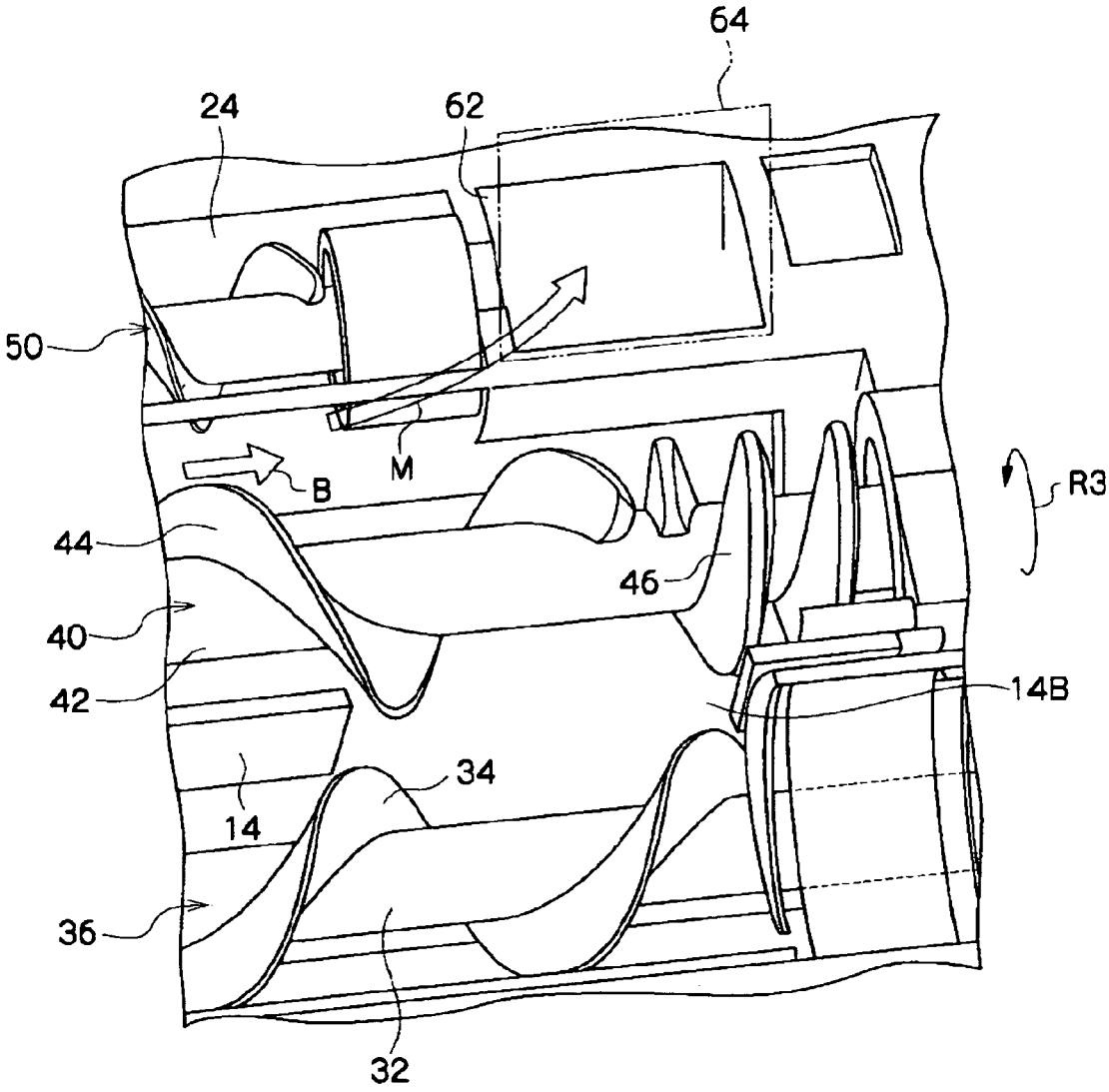
FIG. 12 is a perspective view of a vicinity of the discharge opening at the interior of the developing unit.
Figure 17C:
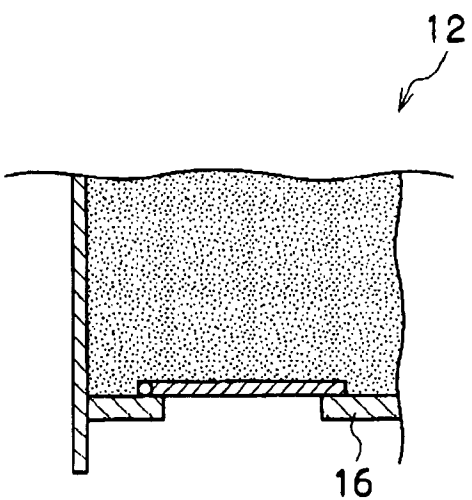
FIG. 17C is a diagram explaining a state in which the developing unit has rotated and the opening/closing member is closed.
Figure 17B:
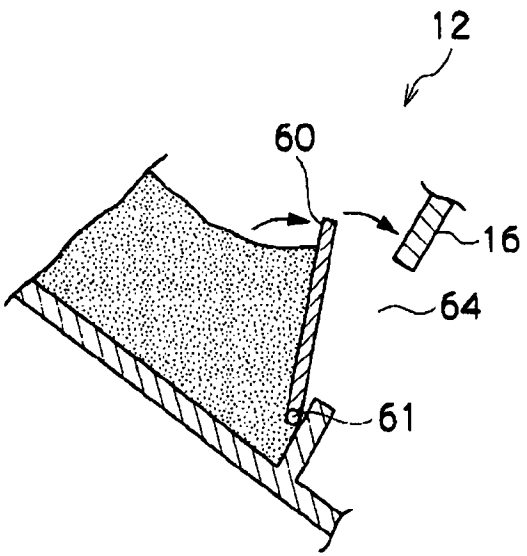
FIG. 17B is a diagram explaining a state in which the developing unit has rotated and the opening/closing member is closing.
Figure 17A:
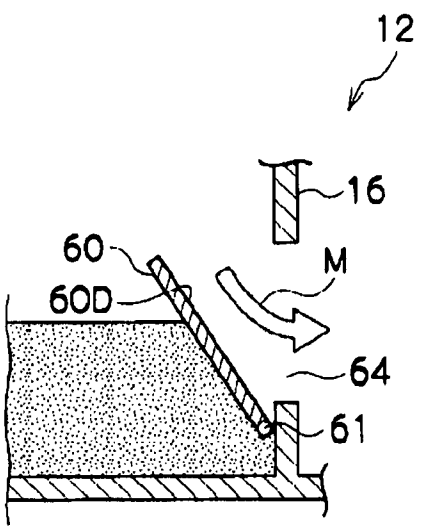
FIG. 17A is a diagram explaining the flow of the developer in a state in which the developing unit is at a developing position.

At the developing position P1, as shown in FIGS. 6, 12 and 17A, the developer is sent in the direction of arrow B by the second stirring/conveying auger 40. Due to the flow shown by arrow M, the excess developer is discharged-out from the discharge opening 64 to the accumulating chamber 62.

At this time, as shown in FIG. 17A, in the state in which the opening/closing member 60 is open, its upper end is open, and the lower end side thereof forms an inclined surface 60D which heads toward the lower end portion of the discharge opening 64. Therefore, the inclined surface 60D guides the developer, which is being discharged, to the discharge opening 64. Accordingly, the developer is discharged smoothly. In other words, the opening/closing member 60 functions both to open and close the discharge opening 64 and to guide the developer to the discharge opening 64.

Further, as shown in FIG. 5A, the outer diameter of only the portion 44L of three windings at the conveying direction downstream side end portion side of the developer conveying portion 44 of the second stirring/conveying auger 40 is made to be slightly larger, such that the gap between the partitioning plate 16 and the portion 44L of the three windings is narrowed. Therefore, the developer which is closer to the partitioning plate 16 can be conveyed. Because the force of conveying the developer is increased in this way, the developer is discharged-out from the discharge opening 64 more smoothly.

Note that the conveying force increases even more if the outer diameter is made to be large along the entire region of the developer conveying portion. However, the gap between the developer conveying portion and the partitioning plate (the inner wall surface) becomes narrower along the entire region of the developer conveying portion. Therefore, there is an increased possibility that the developer conveying portion will rub against the partitioning plate (the inner wall surface) due to flexure or warping of the second stirring/conveying auger, or due to the molding precision (tolerance) of the outer diameter of the developer conveying portion, or the like. Accordingly, in the present exemplary embodiment, the outer diameter of only the portion 44L of the three windings, where the effect on the discharging of the developer is great, is made to be large. In this way, the developer can be discharged more smoothly while rubbing against the partitioning plate 16 (the inner wall surface) is prevented.

Figure 5B:
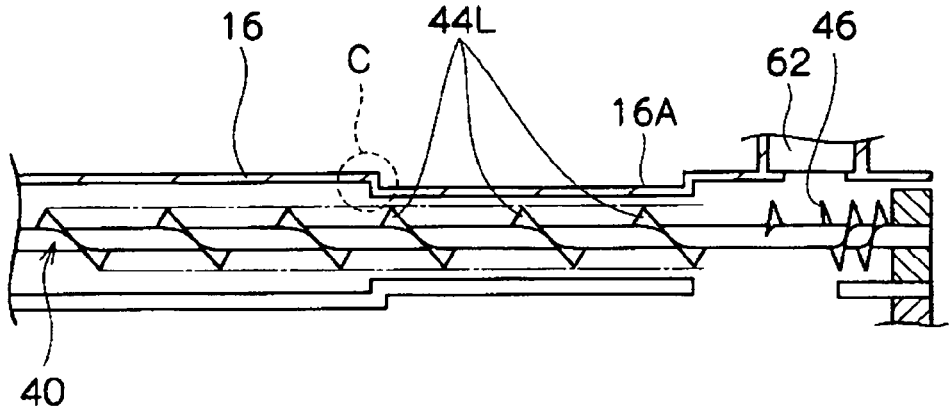
FIG. 5B is a drawing showing another structural example of a vicinity of the discharge opening.
Figure 5C:
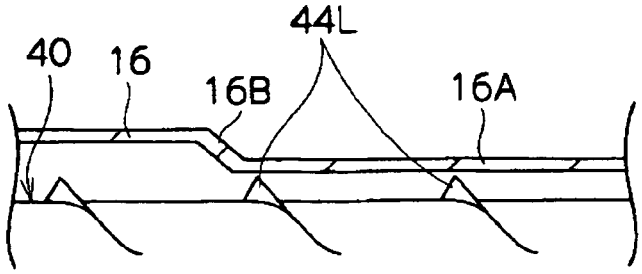
FIG. 5C is a drawing showing a modified example of portion C of FIG. 5B.

Note that, in the present exemplary embodiment, the outer diameter of the developer conveying portion 44 is made to be large. However, as shown in FIG. 5B, a partitioning plate 16A which opposes the portion 44L of the three windings may be set closer so as to narrow the gap between the developer conveying portion 44 and the partitioning plate 16A. At this time, as shown in FIG. 5C, providing an inclined surface 16B and eliminating the step may let the developer flows smoothly.

Further, as shown in FIG. 10A, the inclined surface 60A, which is formed in the shape of a wedge which tapers in the direction opposing the conveying direction, is formed at the end portion of the opening/closing member 60 at the upstream side in the conveying direction. Accordingly, as shown by arrow M and arrow m in FIG. 10A, the developer does not hit the conveying direction upstream side end portion of the opening/closing member 60 and become blocked thereby and accumulate thereat, and rather, is divided as if frayed and is smoothly conveyed and discharged-out from the discharge opening 64.

The inclined surface 60A is formed at the side opposite to the discharge opening 64, and the surface at the discharge opening 64 side is flat. Therefore, as shown in FIG. 10B, in the state in which the opening/closing member 60 is closed, the developer flows at the side opposite to the partitioning plate 16 (the discharge opening 64) as shown by arrow m. Therefore, the flow of the developer does not push the opening/closing member 60 open, and rather, force works in the direction of closing.

Note that, the surface 60A may be inclined at an acute angle.

Moreover, at the end portion at the opposite side (the downstream side end portion in the conveying direction), the inclined surface 60B is formed at the discharge opening 64 side. Namely, the left and right end portions (the upstream side and downstream side end portions) are shapes having point symmetry, and have the same configuration even if the opening/closing member 60 is rotated 180°. Accordingly, even if the opening/closing member 60 is mounted in a state of being rotated 180°, i.e., is mounted with the left and right thereof reversed, the side of the upstream side end portion, which side is opposite to the discharge opening 64, similarly is an inclined surface.

Figure 11A:
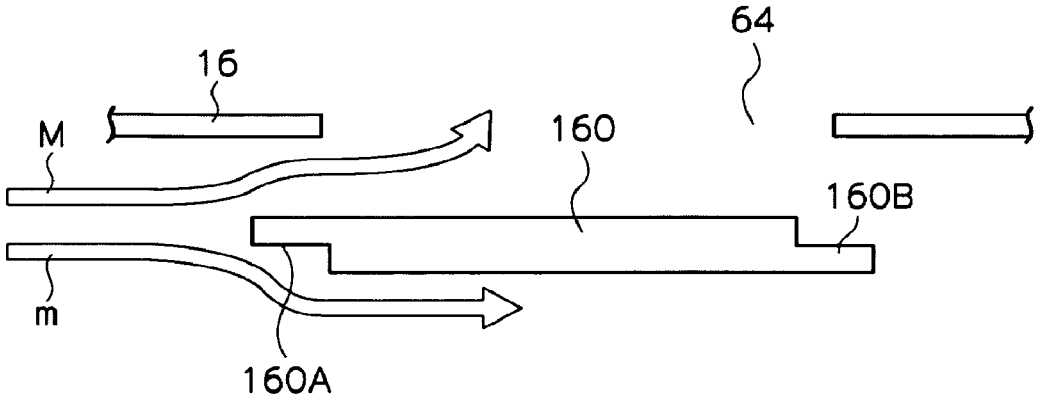
FIG. 11A is a schematic diagram of a cross-section of the state in which the opening/closing member is open.
Figure 11B:
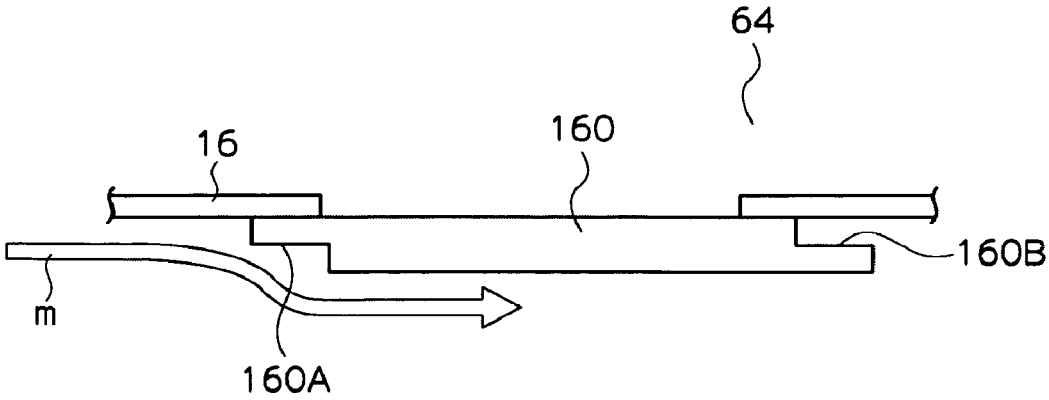
FIG. 11B is a schematic diagram of a cross-section of the state in which the opening/closing member is closed.

Note that it suffices for the structure of the conveying direction upstream side end portion of the opening/closing member 60 to be such that it gradually narrows in the direction opposing the conveying direction (the cross-section gradually becomes smaller), such that the developer is conveyed smoothly without accumulating. For example, as with an opening/closing member 160 shown in FIGS. 11A and 11B and in FIG. 15, there may be a structure in which a step portion 160A is formed at the end portion at the conveying direction upstream side. In this case as well, a step portion 160B which is point-symmetrical at the opposite side end portion may be formed so as to form a structure which allows for mounting even if the left and right are reversed.

Moreover, as shown in order from FIG. 17A to FIG. 17C, due to the rotation of the developing unit 12, the developer covers on so as to close the opening/closing member 60, and therefore, the opening/closing member 60 may close smoothly.

Further, as shown in FIGS. 13, 14, and the like, the upper end portion (the side opposite to the rotating shaft 61) of the opening/closing member 60 is folded-over and is heavy, and the center of gravity of the opening/closing member 60 is upward of the center (at the side opposite to the rotating shaft 61). Therefore, the opening/closing operation of the opening/closing member 60 may be even smoother. Further, at the developing position P1, it may be easy to maintain the state in which the opening/closing member 60 is open.

Figure 15:
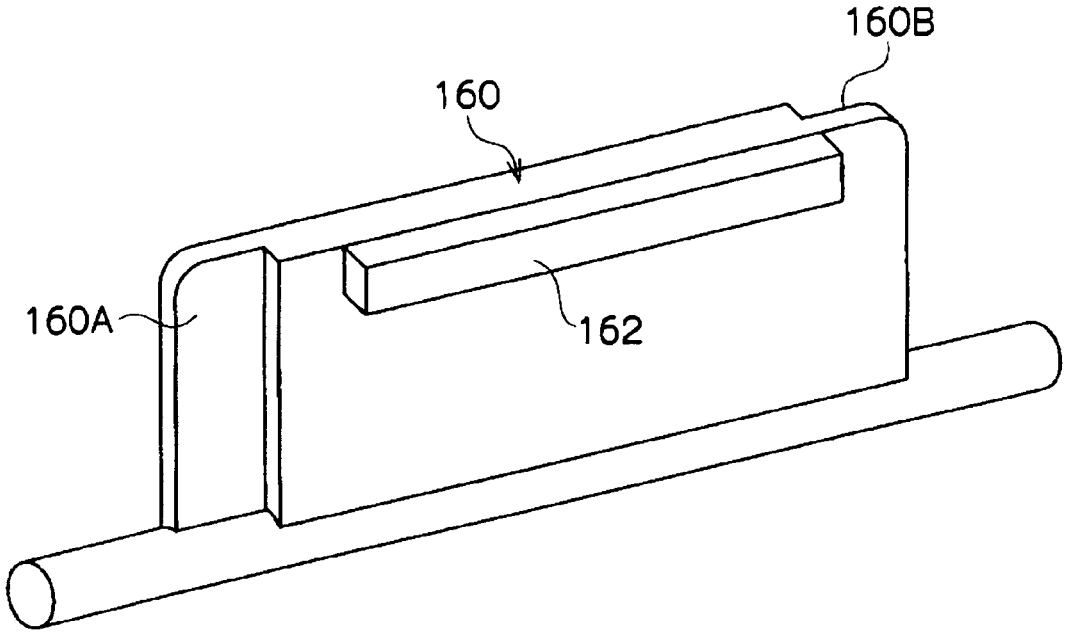
FIG. 15 is a perspective view showing another opening/closing member.
Figure 16:
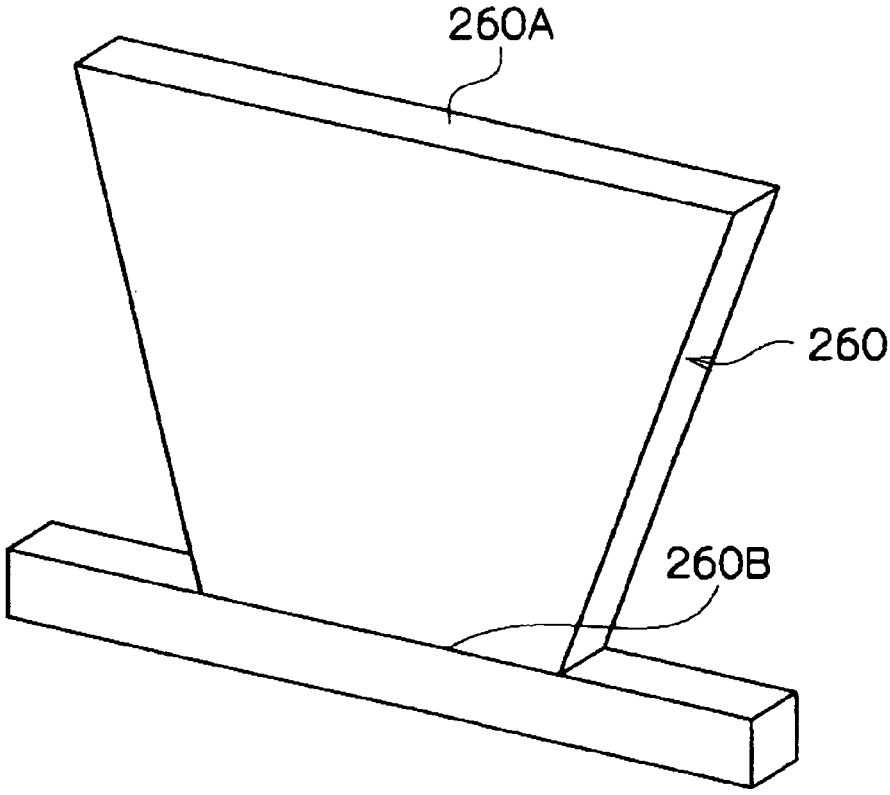
FIG. 16 is a perspective view showing still another opening/closing member.

Note that the structure of setting the center of gravity of the opening/closing member above the center thereof is not limited to that of the above-described exemplary embodiment, and another structure may be employed. For example, as shown in FIG. 15, a weight 162 may be mounted to the upper end portion. Or, a trapezoidal opening/closing member 260, whose upper base 260A is longer than its lower base 260B, may be used.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing unit comprising:

a conveying shaft provided within the developing unit and rotates;

a developing conveying portion that is spiral-shaped, formed at an outer periphery of the conveying shaft, and conveys a developer in an axial direction as the conveying shaft rotates;

a discharge opening provided in an inner wall surface that opposes the conveying shaft, and discharging the developer from the inner wall surface;

an accumulating chamber accumulating the developer discharged from the discharge opening; and an opening/closing member that is plate-shaped, and opens and closes the discharge opening due to its own weight as a rotating body rotates, and is in an open state at a developing position, the developing unit being held at the rotating body, and successively being made to oppose a developing position of an image carrier due to rotation of the rotating body, the opening/closing member having an opening/closing fulcrum at a lower end portion of the opening/closing member at the developing position so as to guide the developer to the discharge opening.

2. The developing unit of claim 1, wherein an end portion of the opening/closing member that is at a side opposite to the opening/closing fulcrum side is heavier than the opening/closing fulcrum side of the opening/closing member.

3. The developing unit of claim 1, wherein the conveying shaft has a developer reverse direction conveying portion that is shaped as a spiral directed reversely to the developer conveying portion, the developer reverse direction conveying portion being provided further than an end portion of the developer conveying portion toward downstream of the conveying direction.

4. The developing unit of claim 1, wherein an interval between the inner wall surface and the developer conveying portion in a vicinity of an upstream side of the discharge opening in the conveying direction is narrowed.

5. The developing unit of claim 4, wherein an outer periphery of the developer conveying portion in a vicinity of an upstream side of the discharge opening in the conveying direction is larger than the outer periphery of the developer conveying portion not in the vicinity of an upstream side of the discharge opening.

6. The developing unit of claim 4, wherein the inner wall surface in a vicinity of an upstream side of the discharge opening in the conveying direction is closer to the developer conveying portion than the inner wall surface not in the vicinity of the upstream side of the discharge opening.

7. A developing unit comprising:

a conveying shaft provided within the developing unit and rotates;

a developing conveying portion that is spiral-shaped, formed at an outer periphery of the conveying shaft, and conveys the developer in an axial direction as the conveying shaft rotates;

a discharge opening formed in an inner wall surface that opposes the conveying shaft, and discharging the developer from the inner wall surface;

an accumulating chamber accumulating the developer discharged from the discharge opening; and an opening/closing member that is plate-shaped, and opens and closes the discharge opening due to its own weight as a rotating body rotates, and is in an open state at a, developing position, a flow regulating portion, whose cross-section narrows in a direction opposing a conveying direction, being formed at a surface of an upstream side end portion of the opening/closing member in the conveying direction, the surface being opposite to the discharge opening, the developing unit being held at the rotating body, and successively being made to oppose a developing position of an image carrier due to rotation of the rotating body.

8. The developing unit of claim 7, wherein the flow regulating portion of the opening/closing member is an inclined surface.

9. The developing unit of claim 7, wherein the flow regulating portion of the opening/closing member is a step portion.

10. The developing unit of claim 7, wherein a downstream side end portion of the opening/closing member in the conveying direction has a configuration that the flow regulating portion of the opening/closing member is rotated at 180°.

11. The developing unit of claim 7, wherein the conveying shaft has a developer reverse direction conveying portion that is shaped as a spiral directed reversely to the developer conveying portion, the developer reverse direction conveying portion being provided further than an end portion of the developer conveying portion toward downstream of the conveying direction.

12. The developing unit of claim 7, wherein an interval between the inner wall surface and the developer conveying portion in a vicinity of an upstream side of the discharge opening in the conveying direction is narrowed.

13. The developing unit of claim 12, wherein an outer periphery of the developer conveying portion in a vicinity of an upstream side of the discharge opening in the conveying direction is larger than the outer periphery of the developer conveying portion not in the vicinity of an upstream side of the discharge opening.

14. The developing unit of claim 12, wherein the inner wall surface in a vicinity of an upstream side of the discharge opening in the conveying direction is closer to the developer conveying portion than the inner wall surface not in the vicinity of the upstream side of the discharge opening.

15. A developing unit comprising:

a conveying shaft means provided within the developing unit and rotates;

a developing conveying means for conveying a developer in an axial direction as the conveying shaft rotates, the developing conveying means being spiral-shaped, and formed at an outer periphery of the conveying shaft means, and;

a discharge opening means for discharging the developer from an inner wall surface, the discharge opening means being provided in the inner wall surface which opposes the conveying shaft means, and;

an accumulating chamber means for accumulating the developer discharged from the discharge opening means; and an opening/closing means for opening and closing the discharge opening due to its own weight as a rotating body rotates, the opening/closing means being plate-shaped, and being in an open state at a developing position, the developing unit being held at the rotating body, and successively being made to oppose a developing position of an image carrier due to rotation of the rotating body, the opening/closing means having an opening/closing fulcrum at a lower end portion of the opening/closing means at the developing position so as to guide the developer to the discharge opening.

* * * * *